United States Patent [19]

Hirai et al.

[11] 3,982,906

[45] Sept. 28, 1976

[54] PRODUCTION OF ALUMINUM-ALUMINUM OXIDE DISPERSION COMPOSITE CONDUCTIVE MATERIAL AND PRODUCT THEREOF

[75] Inventors: Masataka Hirai; Toshio Takahashi; Kishio Arita; Goro Yamauchi; Shugo Kubo, all of Tokai, Japan

[73] Assignee: Nippon Telegraph and Telephone Public Corporation, Japan

[22] Filed: Nov. 14, 1973

[21] Appl. No.: 415,801

[52] U.S. Cl. ..... 29/182.5; 75/206; 75/212; 75/138; 75/148

[51] Int. Cl.[2] ..... B22F 3/00; C22C 21/00

[58] Field of Search ..... 75/206, 212, 138, 148; 29/182.5

[56] References Cited

UNITED STATES PATENTS

| | | | |
|---|---|---|---|
| 3,066,391 | 12/1962 | Vordahl | 75/206 |
| 3,278,301 | 10/1966 | Solomir et al. | 75/206 |
| 3,366,479 | 1/1968 | Storchheim et al. | 75/206 |
| 3,394,000 | 7/1968 | Gualandi et al. | 75/206 |
| 3,791,800 | 2/1974 | McGee | 75/206 |

OTHER PUBLICATIONS

Matthews, International Journal of Powder Met, 4(4), 1968, pp. 39–46.

Alcoa Aluminum Handbook, p. 141, 1957, Aluminum Company of Amer.

*Primary Examiner*—Brooks H. Hunt

*Attorney, Agent, or Firm*—Watson, Cole, Grindle & Watson

[57] ABSTRACT

Manufacture of an aluminum-aluminum oxide dispersion composite conductive material (hereinafter referred to as $Al\text{-}Al_2O_3$ dispersion composite conductive material) by compacting aluminum powder prepared by the atomization method, the particles having an oxide film with a thickness of about 100 A, and heat-treating the resultant compacted material in a vacuum or in a reducing gas or inert gas atmosphere at a temperature of 660° to 700°C. The composite conductive material thus obtained has a structure, in which the aluminum oxide is uniformly dispersed in aluminum, and it is capable of high speed wire drawing. Its electrical conductivity is 56.5 to 63.2 percent IACS (International Annealed Copper Standard), and its aluminum oxide content is 0.01 to 0.2 weight percent.

9 Claims, 2 Drawing Figures

FIG. 1
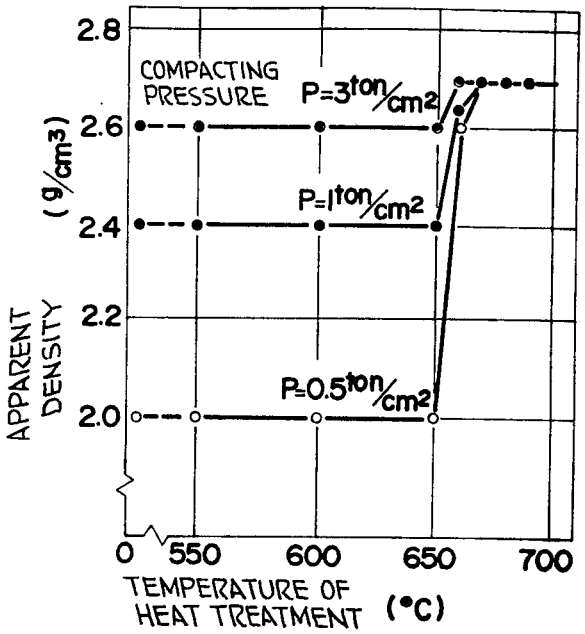
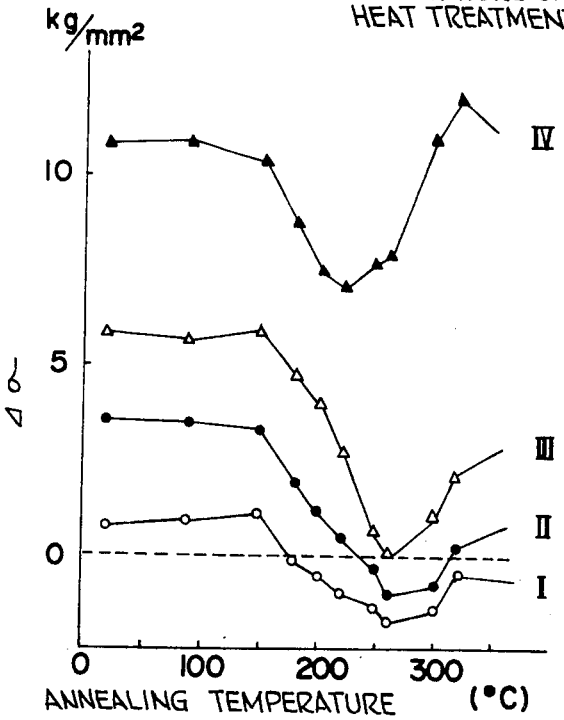
FIG. 2

PRODUCTION OF ALUMINUM-ALUMINUM OXIDE DISPERSION COMPOSITE CONDUCTIVE MATERIAL AND PRODUCT THEREOF

BACKGROUND OF THE INVENTION

This invention relates to a method of manufacturing $Al\text{-}Al_2O_3$ dispersion composite conductive material having an aluminum oxide content ranging from 0.01 to 0.2 percent, the rest being aluminum, and with an electric conductivity value ranging from 56.5 to 63.2 percent 1ACS and the product manufactured by the same method.

Aluminum-aluminum oxide dispersion products are well known in the art to be effective for improving the mechanical strength of aluminum, and they are known as sintered aluminum product (or SAP). Also, there are known various aluminum alloys for utilizing aluminum as conductive material. Aluminum-zirconium alloys and aluminum-iron-silicon alloys are typical examples. The mechanical strength of the $Al\text{-}Al_2O_3$ dispersion products are significantly improved as compared to electronic purpose aluminum (consisting of 99.65 percent aluminum, the rest being impurity) with an increase of the aluminum oxide content (from 7 to 13 weight percent). However, the use of the $Al\text{-}Al_2O_3$ dispersion products as conductive material encounters a problem in that their electrical conductivity is significantly reduced as compared to that of the electrical purpose aluminum by the incorporation of aluminum oxide.

Summary of the Invention

The present invention is based on the finding that if an $Al\text{-}Al_2O_3$ dispersion composite conductive material has a structurally small quantity of aluminum oxide where aluminum oxide is uniformly and finely dispersed in aluminum, its conductivity is very close to that of the electrical purpose aluminum, and nevertheless it has increased mechanical strength such as tensile strength. Also, the particles of aluminum powder as the starting material have a superficial aluminum oxide film with a thickness of about 100 A, and by compacting the material and heat treating the compacted material in a vacuum or in a reducing gas or inert gas atmosphere at a temperature of 660° to 700°C, that is, at a temperature above the melting point of aluminum which is 660°C, the $Al\text{-}Al_2O_3$ dispersion composite conductive material may be readily obtained. This is attributable to the fact that the coefficient of thermal expansion of metallic aluminum is about 5 times that of aluminum oxide, so that during the heat treatment the aluminum oxide film covering the surface of aluminum is ruptured by fused aluminum and fills the interstices of adjacent aluminum particles while without changing the shape of the compacted aluminum body. In the prior-art techniques of aluminum powder metallurgy, the compacted body is sintered at a temperature below its melting point so as to obtain a more dense and ductile product with increased strength of bond between adjacent particles. In this method of producing $Al\text{-}Al_2O_3$ dispersion strengthened product, however, it has been necessary to mechanically and forcibly rupture the aluminum oxide layer, for instance by applying pressure during the sintering step or extruding the material in a hot state. In contrast, according to the invention it is possible to combine the aluminum particles and at the same time finely and uniformly disperse aluminum oxide in the aluminum by merely heat treating the compacted material at a temperature above its melting point for a short period of time. In addition, the content of aluminum oxide in the $Al\text{-}Al_2O_3$ product can be readily controlled by appropriately controlling the grain size of the aluminum powder prepared by the atomization method. In practice, it is possible to obtain $Al\text{-}Al_2O_3$ dispersion composite conductive materials with $Al_2O_3$ content ranging from 0.01 to 0.2 weight percent. This is so because the aluminum oxide film covering the aluminum particles formed by the atomization method is effectively utilized as a dispersion phase in aluminum.

An object of this invention is to provide a method of manufacturing $Al\text{-}Al_2O_3$ dispersion composite conductive materials used as electric conductors.

Another object of the invention is to provide a $Al\text{-}Al_2O_3$ dispersion composite conductive material having high electric conductivity and superior mechanical strength and heat resistivity.

BRIEF DESCRIPTION OF THE DRAWINGS

FIG. 1 is a graph showing the relationship between apparent density of aluminum compacted bodies formed with different compacting pressures, the apparent density being measured after heat treatment, and the temperature of heat treatment.

FIG. 2 is a graph showing tensile strength and heat resistivity of heat treated compacted materials produced from aluminum powders with different grain sizes.

DETAILED DESCRIPTION OF THE PREFERRED EMBODIMENTS

Metal aluminum has a high conductivity, practically next to that of copper, but its mechanical strength is low. On the other hand, various aluminum alloys have high mechanical strength, but their conductivity is very low compared to that of aluminum. The electric conductivity required for using aluminum as an electric conductor is expressed in terms of percentage with respect to the electrical conductivity of annealed copper and is usually shown as IACS percent. The conductivity of pure aluminum is 65 percent IACS, so that a conductivity around this value is required. Meanwhile, the mechanical strength, particularly tensile strength, is required to be about 20 to 30 kg/mm$^2$. As a result of extensive researches for obtaining a material having the aforementioned electrical conductivity and tensile strength, there have been obtained an aluminum-aluminum oxide dispersion composite material and dilute aluminum alloy-aluminum oxide dispersion composite material containing 0.01 to 0.2 weight percent of aluminum oxide dispersed in aluminum.

In order to obtain the conductive material according to the invention, aluminum or dilute aluminum alloy consisting of aluminum as the base material and containing a slight amount of other metal elements capable of oxidation may be utilized in a finely pulverized form. An example of the latter material may be a solid solution containing at least one member of a metal element group consisting of silicon, zirconium, titanium and manganese in an amount below the maximum solubility limit with respect to aluminum, namely 1.65 percent for silicon, 0.28 percent for zirconium, 1.0 percent for titanium and 1.8 percent for manganese. The particle of such finely pulverized material has a superficial flaky oxide film with a thickness of about 100 A formed at the time of pulverization, and the oxide can be utilized as finely disintegrated dispersion phase. The aluminum powder with an aluminum oxide film with a thickness less than about 100 A may be readily prepared through the usual atomization method.

According to the invention, the aluminum powder as mentioned above is compacted by a suitable method, and the compacted material is subjected to a heat treatment in a vacuum or in a reducing gas atmosphere or inert gas atmosphere at range of temperature of 660° to 700°C, that is, at a temperature above the melting point of aluminum, whereby it is possible to obtain an Al-$Al_2O_3$ dispersion composite conductive material containing flaky aluminum oxide of about 2 microns and with a thickness less than about 100 A dispersed in the metal structure.

When the compacted material is heat-treated at range of temperature above the melting point of the aluminum for a predetermined period, the aluminum oxide film covering the surface of the aluminum particle is readily raptured concurrently with the fusion of aluminum due to a great difference in the coefficient of thermal expansion between Al and $Al_2O_3$ to fill the interstices between adjacent aluminum particles, so that the resultant integrated body has very high mechanical strength. Also, the broken aluminum oxide film is dispersed in the aluminum.

FIG. 1 shows the apparent density (in g/cm$^3$) of the compacted material obtained by subjecting samples of the compacted material obtained with compacting pressure ranging from 0.5 to 3 ton/cm$^2$ and heat-treatment under pressure of $1 \times 10^{-2}$ Torr for one hour, the apparent density being plotted against the temperature of the heat treatment ranging from 550° to 700°C. The density of aluminum is 2.70 g/cm$^3$, and its melting point is 660°C. It will be seen that at temperatures below the melting point of aluminum the density increase of the compacted material wil not take place irrespective of the compacting pressure, and the density increase takes place by treating the compacted material at a temperature above the melting point of aluminum irrespective of the compacting pressure. It has also been found that the shape and dimensions of the compacted material will not vary after a heat-treatment at range of temperature of 600° to 700°C for a period of 0.5 to 1.5 hours. It has been recognized, however, that the shape of the compacted material undergoes a change when it is heat-treated at at temperature of 720°C. It has also been recognized that the heat-treated compacted material according to the invention, unlike the prior-art sintered material, undergoes ductile rupture. In case of using an aluminum alloy slightly containing a foreign alloying element it is desirable to conduct the heat treatment at a temperature 10° to 20°C lower than the heating temperature in case of the compacted body of aluminum powder since the melting point of the alloy is slightly reduced.

The heat treatment in the method of manufacturing Al-$Al_2O_3$ dispersion composite conductive material is desirably carried out in an atmosphere under a reduced pressure of $10^{-4}$ to $10^{-2}$ Torr. However, the treatment may also be carried out in a reducing gas atmosphere such as hydrogen or in an inert gas atmosphere. By carrying out the heat treatment in such atmosphere the growth of aluminum oxide layer on the compacted material can be effectively suppressed. Also, doing so is effective for reducing the period of the heat treatment. In order to obtain an Al-$Al_2O_3$ dispersion composite conductive material having high density the pressure of the atmosphere is desirably below $10^{-2}$ Torr. This is because with the heat treatment of the compacted material under this condition liquid phase of aluminum is produced to promote the density increase of the treated material. However, the degree of reduction of pressure in the heat treatment is not critical, but the same end may be achieved by increasing the compacting pressure, as will be understood from FIG. 1.

The observation of the Al-$Al_2O_3$ dispersion composite conductive material obtained by the above method with an electron microscope reveals that the dispersion phase is less than about 2 microns in diameter and is uniformly dispersed. Thus, the heat-treated compacted material is capable of continuous wire drawing. Particularly, the drawing to obtain very fine wires is possible since aluminum is reinforced with the finely distributed aluminum oxide. In an application to drawing where the heat-treated compacted material is passed through a plurality of dies with area reduction factor ranging from 20 to 25 percent and inner diameter ranging from 18 mm to 0.06 mm, a fine wire with a diameter of 60 microns may be obtained through continuous drawing in cold process without any annealing process involved and with an overall drawing factor of 99.998 percent. Further, the conductive material according to the invention is capable of drawing to obtain a wire with a diameter of 20 microns.

The particles of the aluminum powder formed by the aforementioned atomization method have an aluminum oxide film usually as thick as about 100 A. Assuming now that the aluminum particle is truely spherical in shape, the content of $Al_2O_3$ in the Al-$Al_2O_3$ dispersion composite conductive material may be determined as $$Al_2O_3 \text{ (in weight percent)} = \frac{4.0}{2.7} \left\{ \frac{\gamma^3}{(\gamma - 0.01)^3} - 1 \right\}$$

where the density of aluminum is assumed to be 2.7 g/cm$^3$, the density of aluminum oxide 4.0 g/cm$^3$, and $\gamma$ is the radius of the particle. For example, with aluminum particles with a grain size of 44 microns (325 mesh)) the content of $Al_2O_3$ in Al-$Al_2O_3$ dispersion composite conductive material is, from the above equation, 0.2 percent by weight. In this case, 0.18 weight percent was obtained as the content from chemical analysis. It is known that the chemical analysis for determining the content usually involves an error of ±5 to 10 percent. Thus, it can be concluded that the content of aluminum oxide dispersed in aluminum can be controlled by controlling the grain size of the aluminum powder. The electrical conductivity, tensile strength and elongation factor of the Al-$Al_2O_3$ dispersion composite conductive material obtained by the method according to the invention from four different samples of aluminum powder with grain size ranging from 100 microns to 30 microns are tabulated in composition with aluminum conductive material and Al-Zr alloy conductive material for electrical purposes in Table 1.

Table 1

| $Al\text{-}Al_2O_3$ dispersion composite conductive material | | | | | | |
|---|---|---|---|---|---|---|
| | Samples | | | | | Al-Zr alloy |
| | I | II | III | IV | EC-Al | |
| Average grain size (in microns) | 100 | 95 | 81 | 44 | — | — |
| $Al_2O_3$ content (in % by weight) | 0.02 | 0.06 | 0.12 | 0.2 | — | — |
| Conductivity (in % IACS) | | | | | | |
| Directly after heat treatment | 63.2 | 61.7 | 60.5 | 56.5 | 62.4 | 58.5 |
| After annealing at 400°C for one hour | 64.1 | 63.2 | 62.3 | 58.3 | 63.8 | — |
| Tensile strength (in $kg/mm^2$) | | | | | | |
| Directly after heat treatment | 19.5 | 22.5 | 24.8 | 29.7 | 18.5 | 19.1 |
| After annealing at 230°C for one hour | 17.2 | 18.7 | 20.0 | 25.0 | 14.0 | 18.0 |
| Elongation factor (in %) | | | | | | |
| Directly after heat treatment | 3.0 | 3.0 | 3.0 | 3.0 | 2.0 | 2.5 |
| After annealing at 230°C for one hour | 2.5 | 2.5 | 2.5 | 2.5 | — | — |

It will be seen that the electric conductivity either directly after the heat treatment or after annealing at 400°C for one hour is increased with the average grain size of the aluminum powder since aluminum oxide is dispersed in small quantity and uniformly in aluminum. The tensile strength of the material according to the invention is well comparable with or rather superior to that of Al-Zr alloy (containing 0.1 to 0.2 percent of Zr). To demonstrate the heat resistivity of the $Al\text{-}Al_2O_3$ dispersion composite conductive material according to the invention, the tensile strength of some samples after annealing at temperatures up to 230°C for 1 hour is shown in comparison with that of Al-Zr alloy, which is known as typical conductive material of high heat resistance, in FIG. 2. In the graph, the ordinate is taken for $\Delta\sigma$, which is the difference between the tensile strength of the samples according to the invention and that of the Al-Zr alloy. Mathematically stated $$\Delta\sigma = \sigma i - \sigma \text{Al-Zr.alloy}$$

where $i$ designates the number of the sample. The dotted line passing through point O in the ordinate axis thus represents the tensile strength of the Al-Zr alloy annealed at various annealing temperatures. It will be seen from the graph that the tensile strength is greater than that of Al-Zr alloy at any annealing temperature in case of samples III and IV. In case of samples I and II, the tensile strength is greater than that of the Al-Zr alloy at annealing temperatures in a range from 150° to 180°C and is smaller than that of the Al-Zr alloy at annealing temperatures in a range from 180° to 300°C.

According to the invention, the content of $Al_2O_3$ suitably ranges between 0.01 to 0.2 weight percent. In order to obtain an $Al\text{-}Al_2O_3$ dispersion composite conductive material with $Al_2O_3$ content less than 0.01 weight percent, it is necessary to increase the grain size of the atomized aluminum. With an excessively large grain size of aluminum particles the effect of dispersion $Al_2O_3$ is inferior. On the other hand, in order to obtain a $Al\text{-}Al_2O_3$ dispersion composite conductive material with $Al_2O_3$ content in excess of 0.2 weight percent, the grain size of the atomized aluminum must be extremely small. It is not economical and comparatively difficult to obtain such super fine aluminum particles. Another ground for setting the upper limit of the content of $Al_2O_3$ is that there is recognized no necessity of increasing the tensile strength of the conductive material with sacrifice of even the conductivity. From the above grounds, the suitable range of the content of $Al_2O_3$ in the conductive material according to the invention is between 0.01 and 0.2 weight percent. Of course, aluminum particles of different grain sizes may be used in combination.

Without limiting the invention, the following examples are given to illustrate the invention.

EXAMPLE 1

An aluminum alloy containing 0.05 percent of silicon, 0.15 percent of iron and slight amounts of copper and other metal elements, the rest being aluminum, was pulverized by the atomization method. 200 grams of the powder thus obtained was charged into a cylindrical rubber container, which was then sealed against intrusion of external water, and the powder was compacted by using a hydrostatic pressing machine (or rubber press) with a compacting pressure of 3 $tons/cm^2$. The compacted body was cut into pieces with a diameter of 230 to 260 mm and a length of about 145 mm, which were then charged into a furnace serving as a vacuum annealing furnace. The sample thus charged into the furnace was heated under reduced pressure of $1 \times 10^{-2}$ Torr to a temperature of 690°C and was then continually heated at that temperature for one hour. After this heat treatment, the sample retained its original shape, and it has an apparent density of 2.7 $g/cm^3$ and an $Al_2O_3$ content of 0.02 percent. The heat-treated compacted material was then stripped of its surface layer by scalping and was then rendered into rods 18 mm in diameter which were then subjected to drawing. In the drawing process, the sample was first rolled with cold grooved rolls down to a diagonal length of 8 mm, and thereafter it was drawn with dies. Then, the drawing was done with a draw bench to reduce the diameter from 8 mm down to 3 mm, and then it was done with a single-head wire draw bench to reduce the diameter from 3 mm to 0.65 mm. The area reduction factor for each pass was 15 to 25 percent. The drawing speed in the single-head wire draw bench was 10 m/min.

The conductive material manufactured in the above way without any intermediate annealing step involved had an electric conductivity value of 62.0% IACS. Its tensile strength was 20 kg/mm², and its elongation measured for wire with a length of 250 mm was 3 percent. After annealing of the wire at a temperature of 230°C for 1 hour the tensile strength was 17 kg/mm² and the elongation was 3 percent. Also, a wire 0.65 mm in diameter could be continuously drawn into a wire 60 microns in diameter by setting the area reduction factor for each pass to that as mentioned above.

EXAMPLE 2

An aluminum alloy containing 0.06 percent of silicon, 0.1 percent of iron, 0.012 percent of titanium, 0.007 percent of vanadium, 0.0015 percent of manganese and a trace of copper, the rest being aluminum, was used to prepare powder with average grain size of 54 microns (below 400 mesh) by the atomization method. The powder thus prepared was then compacted by the method using a rubber press as shown in Example 1. The compacted material was then subjected to heat treatment under pressure of $10^{-2}$ Torr at a temperature of 690°C for 1 hour. The resultant sample was then subjected to the same drawing process as in Example 1. The conductive material manufactured in this way had an $Al_2O_3$ content of 0.18 percent and a conductivity value of 59.0 percent IACS. The wire obtained from this material through the cold drawing has a tensile strength of 30 kg/mm² and elongation of 3 percent measured with respect to a wire length of 250 mm. After annealing of the same wire at a temperature of 230°C for 1 hour, the tensile strength was 26 kg/mm² and elongation was 3 percent.

EXAMPLE 3

A dilute aluminum alloy containing 0.3 percent of silicon, the rest being aluminum, was used in the form of atomized powder with average grain size of 92 microns to manufacture Al-$Al_2O_3$ dispersion composite conductive material in the manner as in Example 1. The conductive material obtained in this way had an $Al_2O_3$ content of 0.08 percent and a conductivity of 57.0 percent IACS. Its tensile strength was 38 kg/mm², and its elongation was 3 percent. After annealing at a temperature of 230°C for 1 hour, its tensile strength was 26 kg/mm² and its elongation was 3 percent.

EXAMPLE 4

Pure aluminum powder (with average grain size of 81 microns) prepared by the atomization method was compacted by using a rubber press and with a compacting pressure of 3 tons/cm². The compacted material was then heat treated in the atmosphere at a temperature of 690°C for 1 hour. Then, the sample was rendered into rods 18 mm in diameter, which were then drawn into wires 0.65 mm in diameter by the cold drawing process as in Example 1. The sample had an $Al_2O_3$ content of 0.12 percent and a conductivity of 61.9 percent IACS. Its tensile strength was 13.1 kg/mm², and its elongation was 2 percent. After annealing at a temperature of 230°C for 1 hour, its tensile strength was 11 kg/mm² and its elongation was 2 percent.

EXAMPLE 5

Pure aluminum powder (with average grain size of 81 microns) prepared by the atomization method was compacted by using a rubber press and with a compacting pressure of 3 tons/cm². The compacted material was charged into a furnace filled with argon gas and subjected therein to heat treatment at a temperature of 690°C for 1 hour. The heat treated compacted material was then drawn into fine wire 0.65 mm in diameter by the method as in Example 1. The sample had an $Al_2O_3$ content of 0.12 percent and a conductivity of 62.7 percent IACS. Its tensile strength was 15.0 kg/mm², and its elongation was 2.5 percent. After annealing at a temperature of 230°C for 1 hour, its tensile strength was 12.5 kg/mm² and its elongation was 2.5 percent.

EXAMPLE 6

Pure aluminum powder (with average grain size of 81 microns) prepared by the atomization method was compacted by using a rubber press and with a compacting pressure of 3 tons/cm². The compacted material was then charged into a furnace filled with hydrogen gas and was heat treated therein at a temperature of 690°C for 1 hour. Then, the sample was rendered into rods 18 mm in diameter, which were then drawn into wires 0.65 mm in diameter by the cold drawing process as in Example 1. The sample had an $Al_2O_3$ content of 0.12 percent and a conductivity of 62.5 percent IACS. Its tensile strength was 19.5 kg/mm², and its elongation was 3 percent. After annealing at a temperature of 230°C for 1 hour, its tensile strength was 16.5 kg/mm² and its elongation was 3 percent.

EXAMPLE 7

80 grams, 60 grams and 60 grams of different kinds of pure aluminum powder (with respective average grain sizes of 100 microns, 90 microns and 60 microns) prepared by the atomization method were mixed together by a powder mixer, and the blend powder was compacted by using a rubber press and with a compacting pressure of 3 tons/cm². The compacted material was then heat treated in a furnace under a reduced pressure of $10^{-2}$ Torr. The sample was then drawn into fine wire with a diameter of 0.65 mm. The sample had an $Al_2O_3$ content of 0.06 percent and a conductivity of 60.0 percent IACS. Its tensile strength was 22.5 kg/mm², and its elongation was 3 percent. After annealing at a temperaure of 230°C for 1 hour, its tensile strength was 19.5 kg/mm² and its elongation was 3 percent.

What is claimed is:

1. A method of manufacturing an aluminum-aluminum oxide dispersion composite conductive material comprising the steps of:

compacting aluminum powder with an average grain size ranging from 44 to 100 microns with a compacting pressure ranging from 0.5 ton/cm² to 3 tons/cm², the particles of said aluminum powder having a superficial aluminum oxide film; and heat treating the resultant compacted material in an atmosphere under a reduced pressure ranging from $10^{-4}$ to $10^{-2}$ Torr at a temperature ranging from 660° to 700°C for a period ranging from 0.5 hour to 1.5 hours, with the compacted material maintaining its shape and size during the heat treatment.

2. The method of manufacture according to claim 1, wherein said aluminum powder is one for electrical purposes and prepared by the atomizing method and containing 99.65 percent aluminum, the rest being impurity.

3. The method of manufacture according to claim 1, wherein said step of heat-treating the compacted material is carried out in a reducing gas atmosphere such as hydrogen.

4. The method of manufacture according to claim 1, wherein said step of heat treating the compacted material is carried out in an inert gas atmosphere.

5. A method of manufacturing an aluminum-aluminum oxide dispersion composite conductive material comprising the step of:

compacting a dilute aluminum alloy in the form of powder with an average grain size ranging from 44 to 100 microns with a compacting pressure ranging from 0.5 to 3 tons/cm$^2$, said dilute aluminum alloy containing at least one metal element in a group consisting of silicon, zirconium, titanium and manganese, the content of the metal element being 1.6 weight percent in case of silicon, 0.28 weight percent in case of zirconium, 1.0 weight percent in case of titanium and 1.8 weight percent in case of manganese, said dilute aluminum alloy powder being prepared by the atomization method with its particles having a superficial aluminum oxide film; and heat treating the resultant compacting material under a reduced pressure ranging from $10^{-4}$ to $10^{-2}$ Torr at a temperature ranging from 660° to 700°C for a period ranging from 0.5 to 1.5 hours, with the compacted material maintaining its shape and size during the heat treatment.

6. The method of manufacture according to claim 5, wherein said step of heat treating the compacted material is carried out in a reducing gas atmosphere such as hydrogen.

7. The method of manufacture according to claim 5, wherein said step of heat treating the compacted material is carried out in an inert gas atmosphere.

8. Al-$Al_2O_3$ dispersion composite conductive material manufactured by the method defined in claim 1, the composite material consisting of aluminum and containing 0.01 to 0.2 weight percent of $Al_2O_3$, the electrical conductivity of said material being in a range from 58.0 to 64.0 percent IACS, the tensile strength of said material being in a range from 18 to 30 kg/mm$^2$, and the elongation of said material being in a range from 2.5 to 3 percent.

9. Al-dilute alloy-$Al_2O_3$ dispersion composite conductive material manufactured by the method defined in claim 5, the composite material consisting of an alloy composed of aluminum containing 0.01 to 0.2 weight percent of $Al_2O_3$ with respect to aluminum and a slight quantity of at least one element in a group consisting of silicon, zirconium, titanium and manganese, the electrical conductivity of said material being in a range from 57.0 to 64.0 percent IACS, the tensile strength of said material being in a range from 20 to 40 kg/mm$^2$, and the elongation of said material being 3 percent.

* * * * *